US010190332B2

(12) United States Patent
Dixon

(10) Patent No.: US 10,190,332 B2
(45) Date of Patent: Jan. 29, 2019

(54) VEHICLE MOUNTED T-POST REMOVER

(71) Applicant: Donovan Dixon, Roseglen, ND (US)

(72) Inventor: Donovan Dixon, Roseglen, ND (US)

( * ) Notice: Subject to any disclaimer, the term of this patent is extended or adjusted under 35 U.S.C. 154(b) by 0 days.

(21) Appl. No.: 15/697,920

(22) Filed: Sep. 7, 2017

(65) Prior Publication Data

US 2018/0080244 A1 Mar. 22, 2018

Related U.S. Application Data

(60) Provisional application No. 62/397,537, filed on Sep. 21, 2016.

(51) Int. Cl.
*E04H 17/26* (2006.01)

(52) U.S. Cl.
CPC ..... *E04H 17/265* (2013.01)

(58) Field of Classification Search
CPC ..... E04H 17/265
USPC ..... 254/199
See application file for complete search history.

(56) References Cited

U.S. PATENT DOCUMENTS 2,196,366 A * 4/1940 Simmons ..... E21B 19/06 254/106
2,341,106 A * 2/1944 Kuzela ..... E04H 17/265 254/108
5,368,277 A * 11/1994 Moss ..... E04H 17/265 254/30
7,059,587 B1 * 6/2006 Fimple ..... E04H 17/265 254/133 R
7,185,880 B1 3/2007 McCray
7,290,754 B2 * 11/2007 Mensi ..... E04H 17/265 254/133 R
7,950,470 B2 * 5/2011 Reid ..... E04H 17/263 173/184
7,963,051 B2 * 6/2011 Ford ..... E04H 17/265 37/195
8,375,606 B2 * 2/2013 Ford ..... E04H 17/265 37/195
8,608,132 B1 * 12/2013 Allen ..... E04H 17/26 254/130
9,732,541 B2 * 8/2017 Hoovler ..... E04H 17/265
2007/0090332 A1 * 4/2007 Mensi ..... E04H 17/265 254/30
2010/0102285 A1 * 4/2010 Richard ..... E04H 17/265 254/30
2016/0032614 A1 * 2/2016 Spencer ..... A01G 23/062 254/237
2016/0222695 A1 * 8/2016 Hoovler ..... E04H 17/265

* cited by examiner

*Primary Examiner* — Michael E Gallion
(74) *Attorney, Agent, or Firm* — Global Intellectual Property Agency, LLC; Daniel Boudwin

(57) ABSTRACT

A vehicle mounted T-post remover. The vehicle mounted T-post remover comprises a housing having at least one sidewall, an upper end, and an open lower end. At least one sidewall includes an interior surface and an exterior surface. A ratcheting latch system having a release lever is disposed on the interior surface of at least one sidewall. The ratcheting latch system can engage a protrusion of a T-post. The release lever disengages the ratcheting latch system from the protrusion. A curved member is disposed at the upper end and removably secures the vehicle mounted T-post remover to a construction vehicle.

16 Claims, 3 Drawing Sheets

VEHICLE MOUNTED T-POST REMOVER

CROSS REFERENCE TO RELATED APPLICATIONS

This application claims the benefit of U.S. Provisional Application No. 62/397,537 filed on Sep. 21, 2016. The above identified patent application is herein incorporated by reference in its entirety to provide continuity of disclosure.

BACKGROUND OF THE INVENTION

The present invention relates to T-post removers. More specifically, the present invention provides a vehicle mounted T-post remover.

Many construction workers are required to remove installed T-posts. This process is typically time-consuming and labor intensive. It generally requires more than one operator to jack the T-post out of the ground and remove it. Frequently, during this process, the T-posts are damaged and cannot be reused in another project, leading to higher incurred costs. Furthermore, using the current methods, removing multiple T-posts at once takes up even more man-hours, reducing total worker productivity. Therefore, a device that allows a single operator to remove multiple T-posts with a minimum of time and effort is provided.

In light of the devices disclosed in the known art, it is submitted that the present invention substantially diverges in design elements from the known art and consequently it is clear that there is a need in the art for an improvement to existing T-post removal devices. In this regard, the instant invention substantially fulfills these needs.

SUMMARY OF THE INVENTION

In view of the foregoing disadvantages inherent in the known types of T-post removers now present in the prior art, the present invention provides a vehicle mounted T-post remover wherein the same can be utilized for providing convenience for the user when removing T-posts from the ground.

The present system comprises a housing having at least one sidewall, an upper end, and an open lower end, wherein at least one sidewall has an interior surface and an exterior surface. A ratcheting latch system having a release lever is disposed on the interior surface of the sidewall. The ratcheting latch system is configured to engage with the protrusion of a T-post. The release lever is adapted to disengage the ratcheting latch system from the protrusion of the T-post. A curved member adapted to removably secure the housing to the bucket of a construction vehicle is disposed at the upper end. In some embodiments, the housing is cylindrical. In yet other embodiments, the T-post remover further comprises at least one eyelet adapted to attach to a cable disposed on the exterior surface of at least one sidewall. In another embodiment, the cable is adapted to removably secure the housing to the construction vehicle. In some embodiments, the release lever is disposed on the exterior surface of at least one sidewall. In yet other embodiments, the release lever is adapted to attach to a flexible cord. In another embodiment, the curved member comprises a U-shape.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
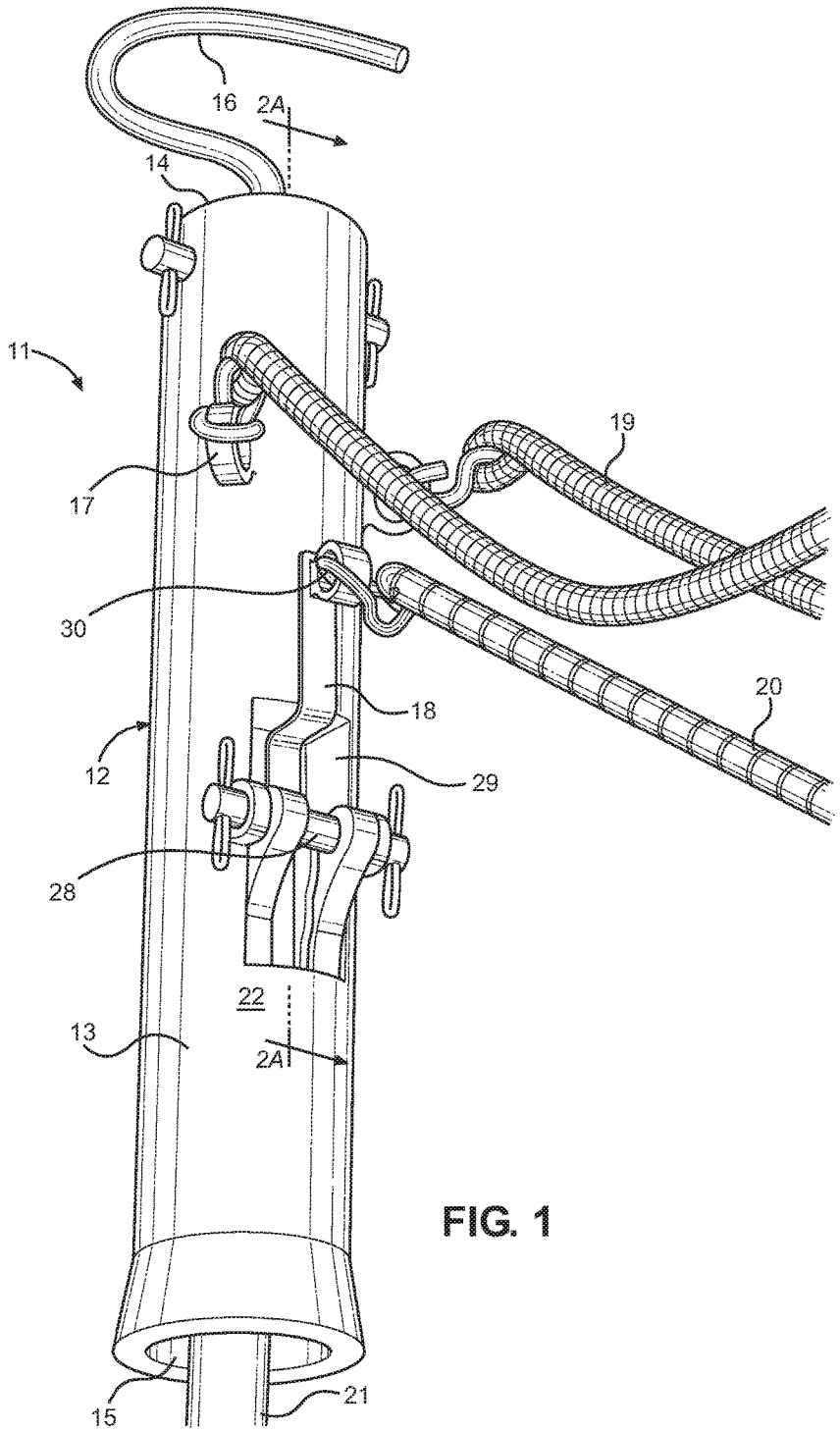
FIG. 1 shows a perspective view of an embodiment of the vehicle mounted T-post remover.

Reference is made herein to the attached drawings. Like reference numerals are used throughout the drawings to depict like or similar elements of the vehicle mounted T-post remover. The figures are intended for representative purposes only and should not be considered to be limiting in any respect.

Referring now to FIG. 1, there is shown a perspective view of an embodiment of the vehicle mounted T-post remover. The vehicle mounted T-post remover 11 comprises a housing 12 having at least one sidewall 13, an upper end 14, and an open lower end 15. In the illustrated embodiment, the housing 12 is cylindrical, however in other embodiments, the housing 12 comprises other shapes including, but not limited to square and rectangular. The open lower end 15 is adapted to receive a T-post 21 into the interior of the housing 12.

Disposed at the upper end 14 is a curved member 16. The curved member 16 is adapted to removably secure the housing 12 to the work bucket of a construction vehicle. In the illustrated embodiment, the curved member 16 comprises a U-shape, however in other embodiments, the curved member 16 comprises other curved shapes, such as a hook. In the illustrated embodiment, the curved member 16 is pivotally attached to the upper end 14 by a rod so as to allow the housing 12 to remain substantially vertical as it is maneuvered. However, in other embodiments, the curved member 16 is integral to the housing 12.

Figure 2A:
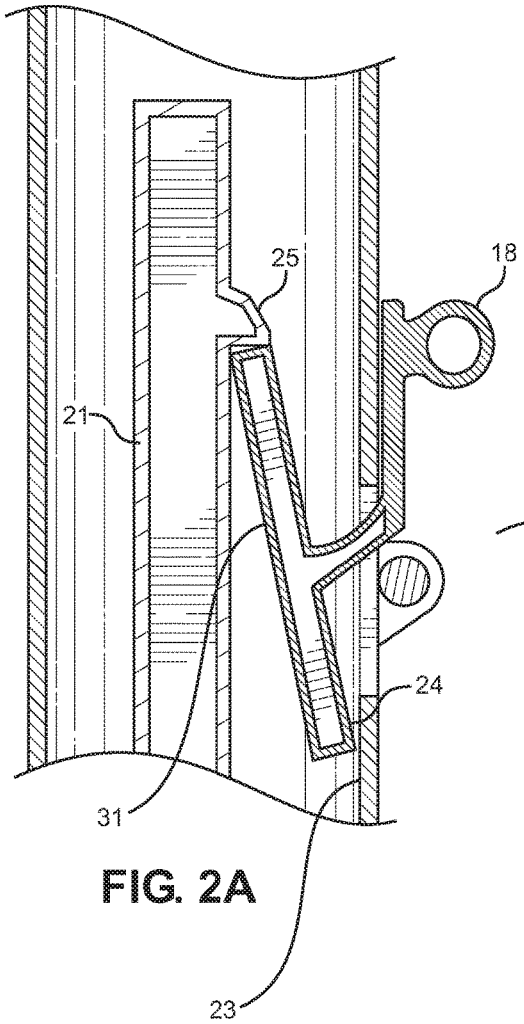
FIG. 2A shows a cross-sectional view of an embodiment of the vehicle mounted T-post remover with the ratcheting latch system in a biased position.

At least one sidewall 13 comprises an exterior surface 22 and interior surface (as shown in FIG. 2A, 23). In the illustrated embodiment, at least one eyelet 17 is disposed on the exterior surface 22. In some embodiments, the vehicle mounted T-post remover comprises a cable 19, wherein an eyelet 17 is adapted to removably secure the cable 19 thereto. In some embodiments, the opposite end of cable 19 is adapted to removably secure the housing 12 to a work bucket of a construction vehicle. In the illustrated embodiment, the opposite end of cable 19 removably secures to the back of the work bucket of a construction vehicle via a fastener, however in other embodiments, the opposite end of the cable 19 can be tied to the construction vehicle. This provides additional stability to the housing 12.

In the illustrated embodiment, a release lever 18 is pivotally affixed to the exterior surface 22 of the housing 12, such that the release lever 18 can selectively move between a biased position and an unbiased position. In the illustrated embodiment, the release lever 18 is in the biased position, wherein the release lever 18 extends through a recess 29 in the housing 12, resting flush against the upper portion of the recess 29 so as to allow the release lever 18 to pivot towards a locking pin 28 disposed on the exterior surface 22 of the housing 12. The locking pin 28 provides a backstop for the release lever 18, preventing the release lever 18 from pivoting beyond the locking pin 28, such that the release lever 18 rests flush against the locking pin 28 in the unbiased position. The release lever 18 further comprises an aperture 30 configured to receive a flexible cord 20 therethrough. The flexible cord 20 allows the user to actuate the release lever 18 from a distance, such as from the cab of a construction vehicle. Actuating the release lever 18 disengages the T-post 21 from the interior of the housing 12.

Figure 2B:
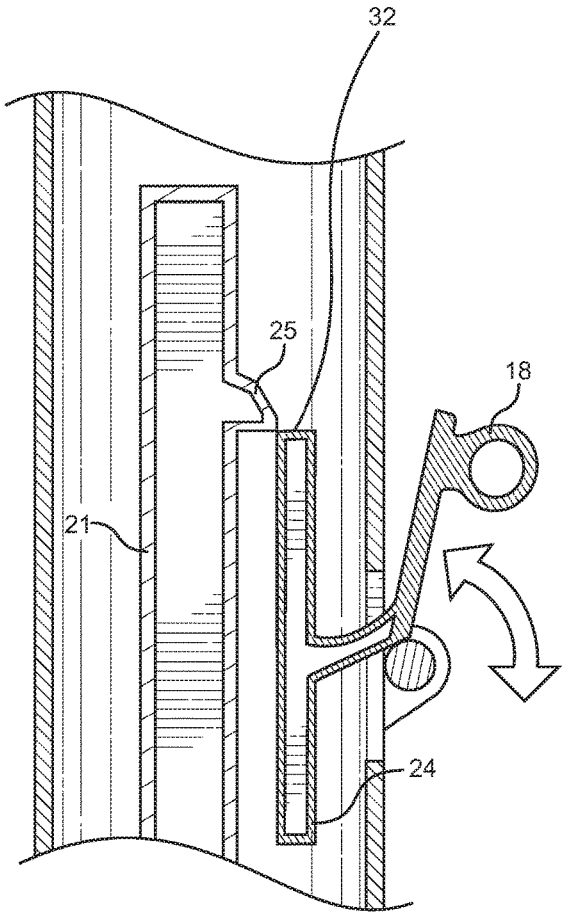
FIG. 2B shows a cross-sectional view of an embodiment of the vehicle mounted T-post remover with the ratcheting latch system in an unbiased position.

Referring now to FIGS. 2A and 2B, there are shown a cross-sectional view of an embodiment of the vehicle mounted T-post remover with the ratcheting latch system in a biased position and a cross-sectional view of an embodiment of the vehicle mounted T-post remover with the ratcheting latch system in an unbiased position, respectively. In the illustrated embodiment, a ratcheting latch system 24 is disposed on the interior surface 23 of the housing. In the illustrated embodiment, the ratcheting latch system 24 comprises a spring-biased plate 31 disposed on the interior of the housing, wherein the spring-biased plate 31 is affixed to the release lever 18. The spring-biased plate 31 is configured to selectively move between a biased position and an unbiased position, wherein the spring-biased plate 31 rests parallel to the housing in the unbiased position and extends into the interior of the housing in the biased position. The spring-biased plate further comprises an upper side 32 configured to contact the protrusion 25. In alternate embodiments, the ratcheting latch system 24 comprises other methods, including gravity assisted and semi-flexible plates and other shapes, such as wedges. The ratcheting latch system 24 is adapted to engage a protrusion 25 of a T-post 21 as an upper side 32 of spring-biased plate 31 physically contacts the protrusion 25, preventing the T-post 21 from exiting the housing when the spring-biased plate 31 is engaged with the protrusion. The release lever 18 disengages the ratcheting latch system 24 from the protrusion 25 of the T-post 21 when actuated, as the upper side 32 moves towards the release lever 18 when the release lever 18 is actuated, such that the upper side 32 no longer contacts the protrusion 25.

Figure 3:
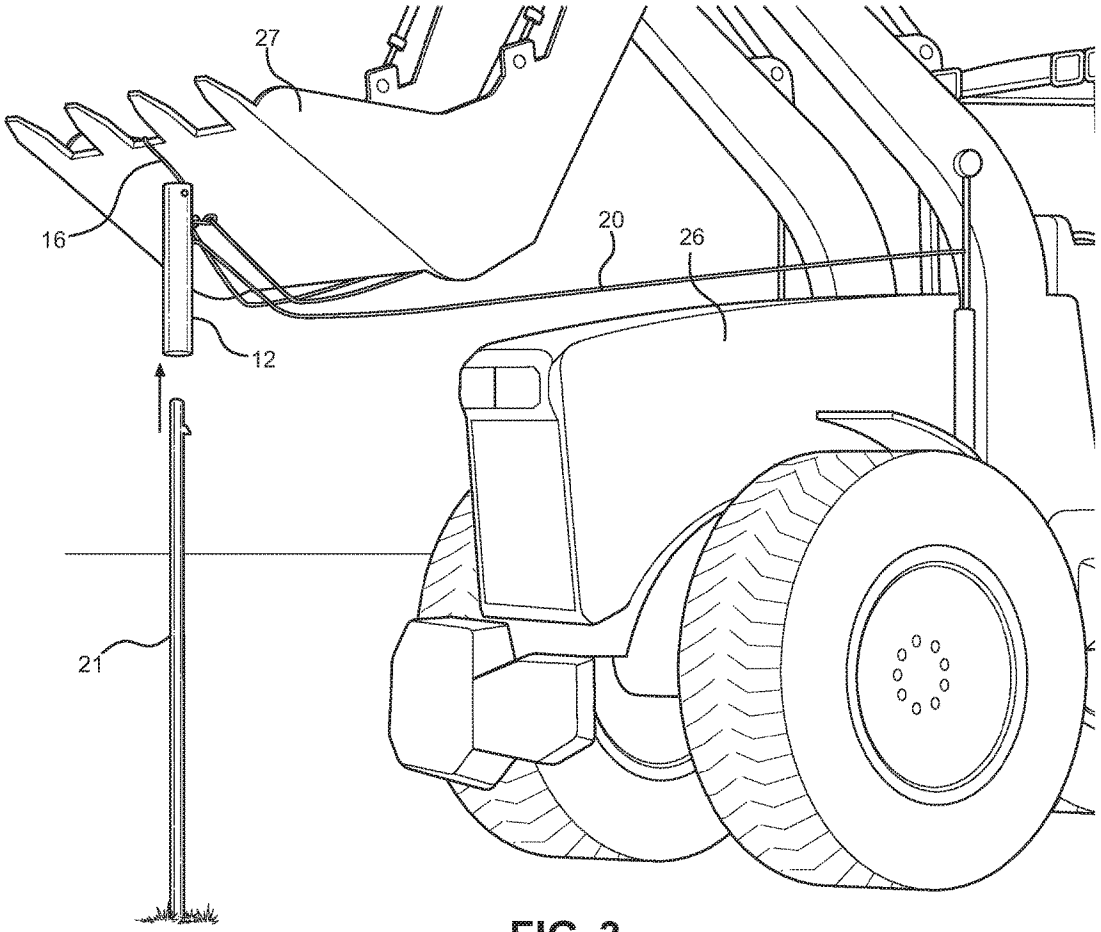
FIG. 3 shows a perspective view of an embodiment of the vehicle mounted T-post remover in use.

Referring now to FIG. 3, there is shown a perspective view of an embodiment of the vehicle mounted T-post remover in use. In the illustrated embodiment, the housing 12 is removably secured to a work bucket 27 of a construction vehicle 26 via the curved member 16. The flexible cord 20 extends from the release lever 18 back into the cab of the construction vehicle 26, allowing the user to actuate release lever 18 from a distance by manually pulling the opposing end of the cord 20. The housing 12 is lowered over the T-post 21, such that the upper end of the T-post 21 enters the lower end of the housing 12 until the protrusion rests above the upper side of the spring-biased plate, such that the protrusion is engaged by the ratcheting latch system. When the release lever 18 is actuated, the T-post 21 is disengaged from the housing 12 and dropped.

In one use, the user attaches the vehicle mounted T-post remover 11 to the work bucket 27 of the construction vehicle 26 via hooking the curved member 16 over the edge of the work bucket 27. The user then attaches the cable 19 to at least one eyelet 17. The opposite end of the cable 19 is then attached to the back of the work bucket 27. The user attaches a flexible cord 20 to the release lever 18 and trails it back to the cab of the construction vehicle 26. The user then maneuvers the construction vehicle 26 such that the housing 12 is disposed above a T-post 21. The work bucket 27 and attached housing 12 are then lowered over the top of the T-post 21 until the ratcheting latch system 24 engages with a protrusion 25 of the T-post 21 as the upper side 32 of the spring-biased plate 31 contacts the protrusion 25. Once the ratcheting latch system 24 is engaged with the T-post 21, the user raises the work bucket 27 and the attached housing 12 removing the T-post 21 from the ground. Once removed, the user then actuates the release lever 18 from the cab of the construction vehicle 26 by pulling flexible cord 20, moving the upper side 32 of the spring-biased plate 31 towards the release lever 18, such that there is no physical contact between the protrusion 25 and the upper side 32, thereby disengaging the T-post 21 from the ratcheting latch system 24, dropping the T-post to the ground. The user then repeats this process for each subsequent T-post 21 that must be removed.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A vehicle mounted T-post remover, comprising:

a housing having at least one sidewall, an upper end, and an open lower end, wherein at least one sidewall has an interior surface and an exterior surface;

a ratcheting latch system having a release lever disposed on the exterior surface of at least one sidewall, wherein the ratcheting latch system is adapted to engage a protrusion of a T-post when the post is positioned within an interior of the housing;

wherein the release lever is adapted to disengage the ratcheting latch system from the protrusion of the T-post when the release lever is actuated;

a curved member extending perpendicularly away from a center of a bar disposed at the upper end, wherein the bar is rotationally affixed to the sidewall;

wherein the curved member is adapted to removably secure the housing to a construction vehicle the release lever engages the sidewall in a first position and disengages the sidewall in a second position.

2. The vehicle mounted T-post remover of claim 1, wherein the housing is cylindrical.

3. The vehicle mounted T-post remover of claim 1, further comprising at least one eyelet disposed on the exterior surface of at least one sidewall, wherein the at least one eyelet is adapted to attach to a cable.

4. The vehicle mounted T-post remover of claim 3, further comprising the cable, wherein the cable is configured to stabilize the housing when a first end of the cable is affixed to the eyelet, and a second end of the cable is removably secured to a work bucket of the construction vehicle.

5. The vehicle mounted T-post remover of claim 1, wherein the release lever is disposed on the exterior surface of at least one sidewall.

6. The vehicle mounted T-post remover of claim 5, wherein the release lever is adapted to attach to a flexible cord.

7. The vehicle mounted T-post remover of claim 1, wherein the curved member comprises a U-shape.

8. The vehicle mounted T-post remover of claim 1, wherein the ratcheting latch system further comprises a spring-biased plate configured to selectively move between a biased position and an unbiased position.

9. The vehicle mounted T-post remover of claim 8, wherein an upper side of the spring-biased plate is configured to engage the protrusion when in a biased position.

10. The vehicle mounted T-post remover of claim 8, wherein an upper side of the spring-biased plate is configured to disengage the protrusion such that the spring-biased plate rests parallel to the housing when in an unbiased position.

11. The vehicle mounted T-post remover of claim 1, wherein the housing further comprises a cutout therein, wherein the release lever is configured to extend through the cutout.

12. The vehicle mounted T-post remover of claim 11, wherein the cutout comprises a height less than that of a spring-biased plate of the ratcheting latch system, such that the spring-biased plate does not extend through the cutout when the release lever is actuated.

13. The vehicle mounted T-post remover of claim 11, wherein a locking pin extends across the cutout, the locking pin configured to prevent the release lever from pivoting beyond a desired position.

14. The vehicle mounted T-post remover of claim 1, wherein the release lever rests flush against an upper portion of the cutout when the release lever is not actuated.

15. The vehicle mounted T-post remover of claim 13, wherein the release lever rests flush against the locking pin when the release lever is actuated.

16. The vehicle mounted T-post remover of claim 1, wherein the curved member is configured to engage with an edge of a work bucket of the construction vehicle.

* * * * *